United States Patent [19]

Brown et al.

[11] 4,243,286

[45] Jan. 6, 1981

[54] INSULATION DISPLACEMENT CONNECTOR

[75] Inventors: Vincent B. Brown, Prospect Heights; Charles A. Kozel, McHenry; John T. Scheitz, Palatine, all of Ill.

[73] Assignee: Methode Electronics, Inc., Chicago, Ill.

[21] Appl. No.: 13,238

[22] Filed: Feb. 21, 1979

[51] Int. Cl.[3] ..... H01R 4/26; H01R 13/50

[52] U.S. Cl. ..... 339/97 R; 339/213 T

[58] Field of Search ..... 339/97 R, 99 R, 97 P, 339/98, 100, 103 R, 213 R, 213 T, 223 R, 258 P, 258 T, 258 R

[56] References Cited

U.S. PATENT DOCUMENTS

| | | | |
|---|---|---|---|
| 3,826,861 | 7/1974 | Karl | 339/98 X |
| 4,018,177 | 4/1977 | McKee | 339/97 R X |
| 4,035,049 | 7/1977 | McKee | 339/97 R |
| 4,050,760 | 9/1977 | Cohen | 339/97 R |
| 4,125,311 | 11/1978 | Hoppe | 339/97 R |

*Primary Examiner*—John McQuade
*Assistant Examiner*—John S. Brown
*Attorney, Agent, or Firm*—Charles F. Pigott, Jr.

[57] ABSTRACT

The disclosed connector has a housing and a terminal interfitted in a channel in the housing, and special exposed jaws are formed on the terminal between which a wire of the type having a conductive core and an insulation overwrap can be forced to establish a mechanically secure and an electrically sound solderless type connection. One pair of jaws are rigid and have cutting and gripping edges that cut through the insulation overwrap to establish electrical contact with the conductive core. These same edges are used to axially restrain the wire relative to the terminal. The second pair of jaws are flexible and have inwardly sloped tabs presenting adjacent edges that are angled transversely of the wire and are spaced apart approximately by the diameter of the insulation overwrap. The wire thus can be forced past the tabs spreading apart the second set of jaws which then spring back and overlie the wire and thereby transversely restrain the wire relative to the terminal.

11 Claims, 7 Drawing Figures

INSULATION DISPLACEMENT CONNECTOR

BACKGROUND OF THE INVENTION

Mating connectors are commonly used to form a separable connection between two flexible electric wires each comprised of a conductive center core and an insulating overwrap. A typical connector includes an exterior nonconductive or insulating housing, and an electrically conductive terminal mounted within the housing. The housings cooperate in typical telescoped fit with one another and wiping or contact areas of the respective terminals engage to establish an electrical connection across the terminals. Each housing further has an opening into which the electric wire fits for making electrical connection with the terminal. Strain relief means must be provided to secure the wire mechanically either to the terminal and/or to the housing.

In some applications, a band of like electrical male terminals are housed within a common housing and define a connector that completes a plurality of electrical connections with a cooperating connector having a like number of female electrical terminals. Further, with the wide use of low voltage electrical control circuits, the size and current carrying capacity of these connectors have been dramatically reduced. Under such circumstances, it is desirable to minimize the manual labor or assembly steps required in order to connect each wire to a corresponding terminal.

One type of conventional connector requires that the wire be cut to length and its end stripped of installation overwrap to expose the conductive center core which is then brought into contact with the terminal and soldered to the terminal. The terminal is then fitted into the housing and locked in a suitable manner to define the terminated connector assembly. A solderless or insulation displacement type connector shortens the foregoing operation in that the wire need only be cut to length and be forced into the terminal, and special cutting edges formed on the terminal automatically displace or strip a portion of the insulation overwrap to establish electrical contact with the conductive center core.

The same cutting and contact edges frequently serve also as the strain relief means securing the wire and terminal mechanically. Additional tabs may be provided on the terminal to dig into the insulation overwrap of the wire as it is positioned in place against the terminal. However, the retaining capacity is limited by the durability and strength of the terminal and the established frictional gripping of the wire and/or insulation overwrap. Frequently, the mere tensioning or pulling the wire at certain angles relative to the terminal or connector releases the strain relief means to allow the wire to become separated from the connector.

Various patents which illustrate solderless electrical connectors to which the invention pertains include U.S. Pat. No. 3,926,498 issued to Hoppe Jr., U.S. Pat. No. 4,040,702 issued to McKee et al, and U.S. Pat. No. 4,050,760 issued to Cohen.

SUMMARY OF THE INVENTION

This invention teaches an improved solderless type electrical connector which includes a terminal that can be readily mounted within an insulating housing and into which a wire having a conductive center core and an insulation overwrap can be mechanically manipulated for establishing both electrically and mechanically sound connections.

The improved solderless connector provides a terminal having two axially spaced pairs of opposed jaws, whereby the wire is aligned over the four jaws and mechanically forced between them. One pair of rigid jaws has opposed edges to displace the insulation overwrap and establish biting frictional engagement against the conductive center core. The other pair of flexible jaws are forced apart by the wire and then spring back to overlie the insulation overwrap of the positioned wire to mechanically secure the wire relative to the terminal. The adjacent edges of tabs formed on the flexible jaws are angled transversely of the wire to allow complete seating displacement of the wire past the tabs to enhance retainment of the positioned wire by the tabs digging into the insulation overwrap should separation of the positioned wire from between the tabs be attempted.

Another object of the invention is to provide terminals which are economical in construction and can be formed while in a side-by-side arrangement on a single sheet or strip of electrically conductive material by stamping, rolling and swedging the same at the selective locations, whereby the formed terminals can be maintained attached on a common strip prior to actual installation to the housing.

DETAILED DESCRIPTION OF THE INVENTION

Figure 1:
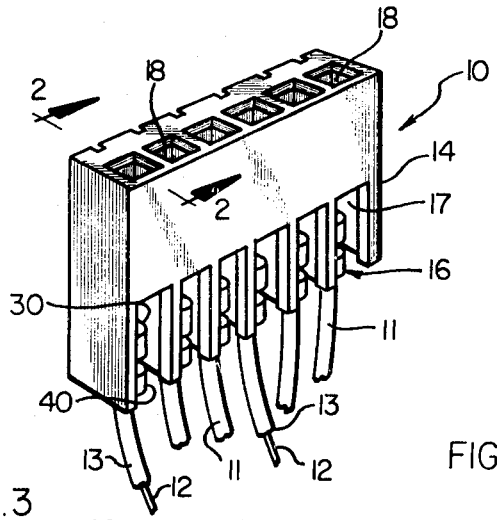
FIG. 1 is a perspective view of a typical connector formed according to the subject invention having a plurality of separate wires and a common housing including aligned openings and guide surfaces adapted to cooperate with a suitable mating connector (not shown) to establish separable electrical connections across the connectors.
Figure 2:
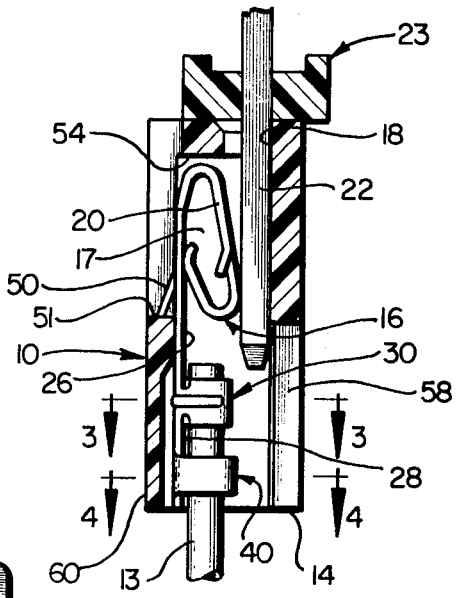
FIG. 2 is a sectional view as seen generally from line 2—2 in FIG. 1, except showing a suitable mating connector cooperating therewith.

As illustrated in FIGS. 1 and 2, an electric connector 10 is shown at the ends of a plurality of separate wires 11 each having a conductive core 12 and an insulation overwrap 13. The connector 10 is comprised of a housing 14 of plastic or other nonconductive or insulating material and a plurality of separate terminals 16 mechanically and electrically connected relative to the wires 11. Each terminal 16 is mechanically restrained in a channel 17 in the housing 14 so that the wires 11 are secured mechanically to the housing 14. An opening 18 in the housing lines up with each channel and specifically with a wiping contact section 20 formed on the terminal 16 (see FIG. 2) to thereby allow for the insertion of a cooperating male terminal 22 of a mating connector 23. This establishes a separable electrical connection across the terminals. In a typical installation, many parallel terminals like that illustrated at 22 are supported within the connector 23 or from a printed circuit board (not shown) to cooperate respectively with a like number of separate terminals 16 within the connector 10.

The terminals 16 are formed of an electrically conductive material, such as a composition of brass or the like, and can be plated or not plated with tin or gold to suit the particular end use of the connector. The described cooperation of the connectors 10 and 23 is not the subject of this invention, but has been described as background information for a more complete understanding of the instant invention.

Figure 3:
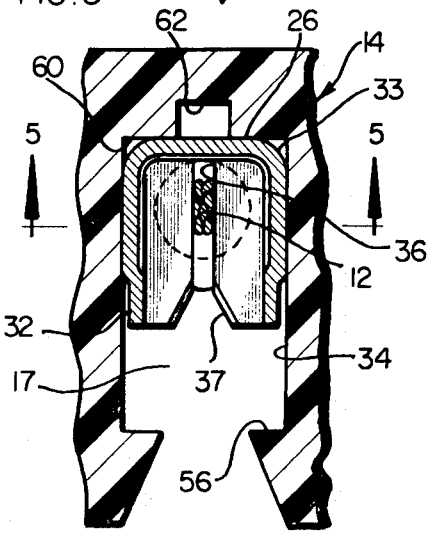
FIGS. 3 and 4 are sectional views as seen respectively from lines 3—3 and 4—4 in FIG. 2.
Figure 4:
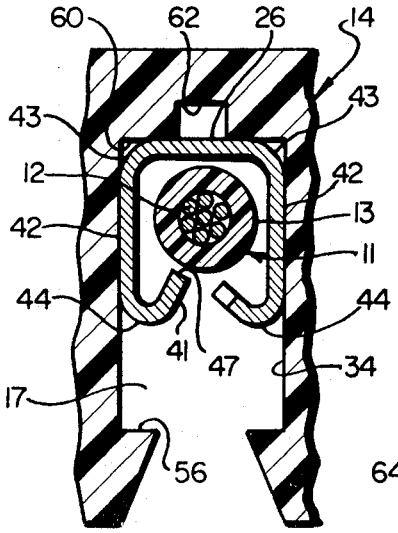

The terminal 16 has a base 26 which extends from the contact section or end 20 to a wire gripping section or end 28. Located at the wire gripping end 28 are two pairs of opposed jaws 30 and 40 which are located in axially spaced opposing relationships along the length of the base 26 or the defined housing channel 17. Each pair of jaws has upstanding sidewalls, 32 and 42 respectively which are folded along axial corners 33 (see FIG. 3) and 43 (see FIG. 4) from the base and which project substantially normal to the base. These side walls 32 and 42 are adapted to fit within the housing channel 17 with the remote sides of the jaw sidewalls being closely adjacent and laterally confined by the mutually facing housing walls 34 defining the channel as shown in FIGS. 3 and 4.

The jaws 30 have flanges 35 folded in from the corners 32*e* of the sidewalls 32 to present parallel edges 36 spaced apart a distance slightly less than the interior conductive wire core 12. Knife edges 37 converge to edges 36 in the direction toward the base 26 from a lateral spacing corresponding to that across the wire insulation overwrap 13.

The jaws 30 are thus suited to allow the wire 11 to be placed transversley across the knife edges 37 and then forced in a direction in line with the edges 36 towards the base 26, whereupon the knife edges 37 cut through the insulation and contact the conductive core 12, while continued transverse wire movement ultimately bottoms the wire against the base and further provides tight frictional contact between the parallel jaw edges 36 and the conductive core 12.

Figure 7:
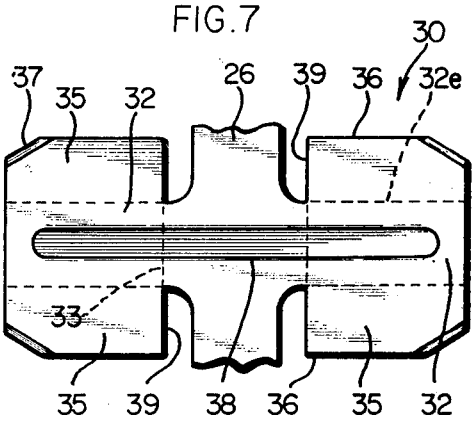
FIG. 7 is a development view of the terminal components illustrated in FIGS. 3 and 5, but prior to complete fabrication thereof.

The jaws 30 serve as both the means for establishing electrical contact with the wire and for axially restraining or securing the wire; and the electrical contact is redundant since it is at all four jaw edges 36. In order to strengthen the jaw sidewalls 32, it is preferred to form a swedged embossment 38 which extends almost the length of the jaw sidewalls and further across the base 26 and the sidewall axial corners 33 (see FIG. 7). This gives to the jaw sidewalls 32 and to the base 26 a three dimensional shape stronger against bending of the sidewalls relative to the folded connection to the base. Further, the flanges 35 are separated across a necked area from the base 26 to define an edge 39 (see FIG. 7) that overlies and directly abuts the base 26 after the sidewall 32 and flanges 35 are bent up and over respectively. Since the preferred jaw configuration provides two flanges 35 for each jaw sidewall 32, the abutment of the flange edges 39 against the base are at axially spaced locations relative to both the sidewall axial corner 33 and the embossment 38. This further stabilizes and strengthens the jaws against twisting about transverse axes through the base 26, and the resulting U-shaped configuration of the jaws 30 increases their rigidity when the wire 11 is forced therebetween.

The jaws 40 have the sidewalls 42, and tabs 41 are connected at axial corners 44 to the upper free edges of the sidewalls. Each tab 41 slopes inwardly towards the opposite sidewall and downwardly toward the base 26, and define free edges 45 that are angled slightly in directions transverse relative to the base 26 or to the elongate housing channel 17 as the terminal is positioned in the channel. Preferably, the edges 45 are generally parallel and are separated from one another by a distance slightly less than the diameter of the insulation overwrap 13. The endmost or innermost projections 47 of the tab edges 45 thus are axially offset or spaced from one another, and extend approximately to or just short of the midpoint of the base 26 in spaced overlying relationship to the base. Preferably, each tab 41 is backfolded from axial corner 44 downwardly toward the base at approximately between 135° and 165° relative to its sidewall 42.

It is to be noted that an elongate wire positioned crosswise over the jaws 40 can be moved between the jaw tabs 41 towards the base 26 to cause the wire when bottomed against the base to underlie the jaws tabs and particularly the edge projections 47. As previously noted, since the exterior dimension across the sidewalls 42 is only slightly less than that across the opposed housing walls 34, the jaw side-walls cannot be excessively flexed outwardly. However, because the tab edges 45 are properly spaced apart and are angled transverse to the base 26 and to the wire 13, the wire can be fitted or snaked past the tabs and against the base with little deflection of the jaw sidewalls 42 and tabs 41. On the other hand, once the wire 13 is positioned beyond the jaw tabs 41, transverse withdrawal movement of the wire relative to the jaw tabs is prevented because the tab projections 47 overlie and engage the insulation overwrap 13.

The channel 17 of the housing 14 receives the terminal 16 (FIG. 2) until a barb 50 on the terminal is moved past a shoulder 51 on the housing. The wiping contact end 20 of the terminal abuts the housing end wall 54 to limit inserting terminal movement into the channel. Shoulders 56 (FIG. 4) are formed from housing walls 34 to overlie the jaw tabs 41. The terminal 16 is fixed relative to the housing 14 initially with no wire 13 connected to it. The channel adjacent the wire end of the terminal is U-shaped having a top opening 58 as shown in FIG. 2, thereby exposing and providing accessibility to the jaws 30 and 40. In this manner, the wire 13 can be positioned over the jaws 30 and 40 and forced by a tool (not shown) crosswise of and into the confines of the jaws and against the base 26.

The axial corner support of the jaws 30 and 40 virtually eliminate any stress concentration areas along the base 26, which otherwise could be overloaded should an oversized or hard wire be used with the connector. Also, the housing sidewalls 34 preclude lateral separation of the jaws beyond a certain point to help the knife edges 37 penetrate the insulation overwrap 13. The knife edges 37 can be swedged onto the edges of the flanges 35. Moreover, the wire 13 is inserted clear against the base 26, and in a preferred embodiment the housing wall 60 underlying the jaws is relieved or grooved as at 62 (see FIGS. 3 and 4). In this manner, the strains against the terminal and the housing will more readily be accommodated without damage to either. The groove 62 extends axially under the jaws 30 and 40, but laterally at most only under the middle third of the channel 17. Optionally of course, the groove 62 can be eliminated.

It will further be noted the connector 10 is of the axial type, meaning that the inserted male terminal 22 fits into the housing channel 17 that extends completely through the housing 14, and the wire 13 connected to the terminal 16 is in line axially but is laterally offset from the terminal 22. This can be of importance since the length of the male terminal 22 and the depth of penetration into the illustrated connector 10 is not limited as would be the case if the wire 13 as terminated were perpendicular to the base 26.

Figure 6:
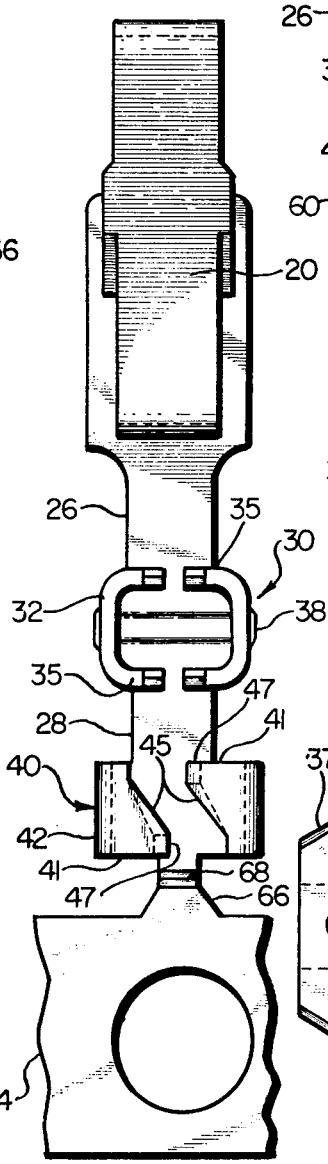
FIG. 6 is a plan view showing the terminal as it and like terminals are formed from a single sheet of conductive material.
Figure 5:
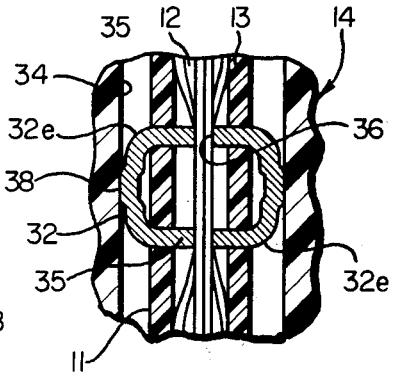
FIG. 5 is a sectional view as seen generally from line 5—5 in FIG. 3.

Of interest further to the particular terminal 16 is the method by which it and like terminals are formed from a single elongate strip or reel 64 (see FIG. 6) of electrically conductive material in side-by-side relation. The various jaw, locking barb and wiping contact components are biased upwardly or downwardly from the sides of the base wall 26 by stamping, swaging or rolling tools while the base wall is maintained connected to the remainder of the strip. Thus, the adjacent terminals 16 can be maintained integral to the strip or common piece 64 from which the terminals are formed.

The neck section 66 between the base 26 and the strip 64 can be scored partway through as at 68 to allow for individual terminals to be easily bent off or broken from the common fabrication strip. The formed terminals 16 still connected to the common strip 64 can in fact be rewound into a reel or coil for compact storage and easy transportation, while allowing for highly automated connection of the terminal 16 relative to the connector 10 and the wire 13.

What is claimed is:

1. An insulation displacement connector for an electric wire having a conductive core and an insulation overwrap, comprising the combination of a housing having walls defining an elongate channel and a terminal adapted to fit within the channel and present an exposed wire securing end to which the wire is to be connected, said wire securing end having a base and first and second pairs of opposed jaws upstanding therefrom at axially spaced locations along the base, the first pair of jaws including knife edges converging to opposed gripping edges adjacent the base that are spaced apart transversely of the channel a distance slightly less than the diameter of the conductive core, the second pair of jaws having opposed tabs angled toward the base and each other, said tabs terminating along adjacent edges that extend partially transverse to the channel and thereby terminate at axially offset endmost projections disposed approximately halfway across the channel and spaced above the base distances corresponding approximately to the diameter of the insulation overwrap, whereby when said wire with the overwrap thereon is aligned over the exposed pairs of jaws and forced transversely therebetween and against the base, said knife and gripping edges of the first pair of jaws displace the insulation overwrap and frictionally contact the conductive core to establish an electrical connection between the terminal and wire and also to axially restrain the wire relative to the terminal, and the tabs on said second pair of jaws overlie and trap the wire against the base and transversely restrain the wire relative to the terminal.

2. An insulation displacement connector according to claim 1, wherein the first pair of jaws includes sidewalls upstanding along axial fold lines from said base, said cutting and gripping edges being formed on flanges supported from the sidewalls, and wherein both the base and sidewalls are mechanically deformed to define embossment means that extend crosswise of the axial fold lines thereby strengthening the sidewalls and increasing axial restraining of the wire relative to the terminal.

3. An insulation displacement connector according to claim 2, wherein the flanges are connected to the sidewalls along fold lines disposed transversely of the base, and wherein each flange defines a lower edge that overlies and abuts the base at a location axially offset from the sidewall fold lines.

4. An insulation displacement connector according to claim 3, wherein two flanges are formed on each sidewall and have lower edges that overlie and abut the base on opposite axial sides of said embossment means.

5. An insulation displacement connector according to claim 1, wherein said housing channel walls include facing walls separated a distance only slightly greater than the distance across the transverse exterior dimensions of said first and second pairs of jaws, whereby said jaws are mechanically constrained to minimize release of the restrained wire.

6. An insulation displacement connector according to claim 1, wherein the second pair of jaws includes sidewalls upstanding along axial fold lines from said base, and wherein the tabs of the second pair of jaws are supported from the sidewalls along axial fold lines spaced from the base at least by the diameter of the wire overwrap.

7. An insulation displacement connector according to claim 6, wherein shoulders project from the housing channel walls that overlie said tabs and preclude transverse movement of the terminal out of the channel.

8. An insulation displacement connector according to claim 5, wherin both the first and second pairs of jaws include sidewalls upstanding along axial fold lines from the base, wherein both the base and sidewalls of the first pair of jaws are mechanically deformed to define embossment means that extend crosswise of the axial fold lines thereby strengthening the sidewalls and increasing axial restraining of the wire relative to the terminal, and wherein the tabs of the second pair of jaws are supported from said corresponding sidewalls along axial fold lines spaced from the base at least by the diameter of the wire overwrap.

9. An insulation displacement connector according to claim 8, wherein two flanges are formed on each sidewall and have lower edges that overlie and abut the base on opposite axial sides of said embossment means.

10. An insulation displacement connector according to claim 9, wherein shoulders project from the housing channel walls that overlie said tabs and preclude transverse movement of the terminal out of the channel.

11. An insulation displacement connector according to claim 1, further providing that like terminals are formed from a common strip of conductive material in adjacent side-by-side relation, and wherein the base of each terminal adjacent the second pair of jaws is integral with the strip across a scored line to allow easy breaking separation of the terminal from the strip.

* * * * *